US006546564B1

(12) United States Patent
Palmer

(10) Patent No.: US 6,546,564 B1
(45) Date of Patent: Apr. 15, 2003

(54) HOSIERY

(75) Inventor: Vanessa Anne Palmer, Brisbane (AU)

(73) Assignee: Hippies Pty Ltd., Milton (AU)

( * ) Notice: Subject to any disclaimer, the term of this patent is extended or adjusted under 35 U.S.C. 154(b) by 0 days.

(21) Appl. No.: 09/581,985

(22) PCT Filed: Dec. 23, 1998

(86) PCT No.: PCT/AU98/01062

§ 371 (c)(1),
(2), (4) Date: Jun. 20, 2000

(87) PCT Pub. No.: WO99/33366

PCT Pub. Date: Jul. 8, 1999

(30) Foreign Application Priority Data

| | | |
|---|---|---|
| Dec. 24, 1997 | (AU) | PP1120 |
| May 29, 1998 | (AU) | PP3776 |
| Jul. 27, 1998 | (AU) | PP4845 |
| Aug. 6, 1998 | (AU) | PP5072 |

(51) Int. Cl.[7] ..... A41B 9/04
(52) U.S. Cl. ..... 2/239; 2/409
(58) Field of Search ..... 2/239, 220, 221, 2/400, 401, 236, 409, 237, 240, 241, 242; 450/109, 132, 151, 154, 122

(56) References Cited

U.S. PATENT DOCUMENTS

| | | | | |
|---|---|---|---|---|
| 504,402 A | | 9/1893 | Pike | |
| 1,998,140 A | * | 4/1935 | Loew | 2/224 |
| 2,367,328 A | | 1/1945 | Bercaitz | |
| 2,424,651 A | | 7/1947 | Dubner | |
| 2,687,526 A | | 8/1954 | Blais | |
| 2,872,685 A | * | 2/1959 | Denbo | 2/224 |
| 3,487,473 A | | 1/1970 | Jahnsen | |
| 3,517,666 A | * | 6/1970 | Atlee | 128/159 |
| 3,566,624 A | | 3/1971 | Burleson | |
| 3,599,241 A | | 8/1971 | Rossler | |
| 3,654,634 A | * | 4/1972 | Torres | 2/224 |
| 3,797,501 A | | 3/1974 | Di Tillio | |
| 3,802,229 A | | 4/1974 | Fregeolle | |
| 3,824,812 A | | 7/1974 | Matthew et al. | |
| 3,914,799 A | | 10/1975 | Newmar | |
| 3,999,406 A | | 12/1976 | Boeckle et al. | |
| 4,021,861 A | | 5/1977 | Imboden et al. | |
| 4,040,128 A | | 8/1977 | Imboden | |
| 4,059,973 A | | 11/1977 | Gresillon | |
| 4,400,832 A | * | 8/1983 | Kinder | 2/406 |
| 4,412,433 A | | 11/1983 | Satrit et al. | |
| 4,523,337 A | | 6/1985 | Leibowitz | |
| 4,872,324 A | | 10/1989 | Rearwin et al. | |
| 5,023,957 A | | 6/1991 | Harvey | |
| 5,226,297 A | | 7/1993 | Manini | |
| 5,519,894 A | | 5/1996 | Imboden et al. | |
| 5,547,466 A | * | 8/1996 | McRoberts et al. | 602/70 |
| 5,762,535 A | | 6/1998 | Nishiyama et al. | |
| 5,875,495 A | * | 3/1999 | Thrower | 2/403 |

FOREIGN PATENT DOCUMENTS

| | | |
|---|---|---|
| DE | 2909613 | 9/1980 |
| DE | 2650167 | 5/1997 |
| EP | 0711513 | 5/1996 |
| FR | 2290855 | 6/1976 |
| JP | 09-078306 | 3/1997 |
| WO | WO98/19566 | 5/1998 |

* cited by examiner

*Primary Examiner*—Gloria M. Hale
*Assistant Examiner*—Alissa L. Hoey
(74) *Attorney, Agent, or Firm*—Finnegan, Henderson, Farabow, Garrett & Dunner

(57) ABSTRACT

A garnet or hose retaining system comprises an elasticised retaining band (83) extending in use around a rear position (83*a*) of a wearer's anatomy and a front portion (83*b* in use at least partially across a front portion of the wearer's Danatomy. The rear portion (83*a*) has a modulus of elasticity extending generally longitudinally and parallel to its upper and lower boundaries. The front portion (83*b*) comprises a gerally downwardly extending arcuate concave curve (85) in an upper boundary, and has a greater modulus of elasticty in a transverse direction than longitudinally of the front portion.

17 Claims, 14 Drawing Sheets

31
22
30
28
31
27
25
21
23
24
29

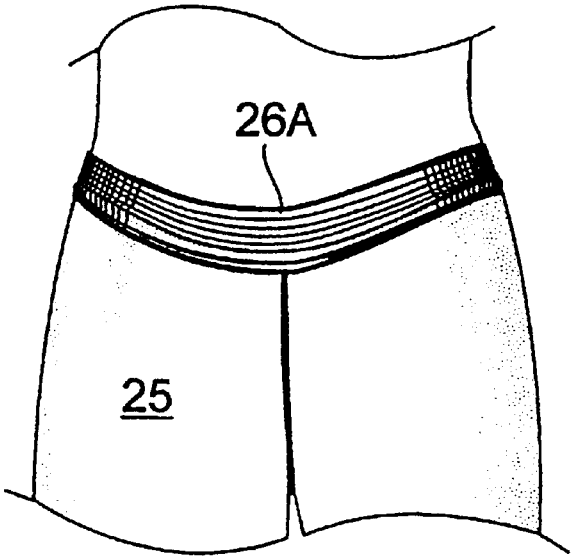
FIG. 8
FIG. 9
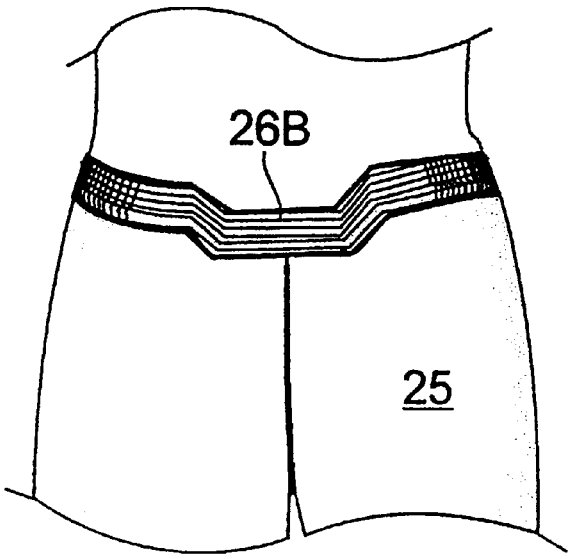

HOSIERY

FIELD OF THE INVENTION

THIS INVENTION is concerned with improvements in underwear and hosiery and, in particular, to improvements in women's pantihose.

The invention is also concerned with improvements in retaining bands for the aforesaid garments.

BACKGROUND OF THE INVENTION

Traditionally, women's pantihose have been styled so that the elasticized waistband is located in the mid-riff region, some 50 mm to 75 mm above the iliac crests of the pelvis, commonly known as the hip bones.

With current fashion trends dictating shorter waisted upper and lower garments to expose portion of the torso and the navel in particular, traditional high waisted pantihose need to be rolled downwardly from the waistband to avoid exposure.

A difficulty associated with this practice is that the rolled down portion is both uncomfortable due to increased tension and unsightly due to the increased bulk in this region.

A further difficulty arises from the tendency of the rolled waistband portion either to roll upwardly and become exposed on women with a narrow waist or to continue to roll downwardly on women having a larger waist.

Even for women who do not wish to bare their midriff in current fashions, high waisted pantihose can still be uncomfortable with a fairly tight waistband located so far above the hip region.

Whether small or large waisted, most women encounter a tendency for the waistband of their pantihose to roll downwardly as a result of normal bending movements.

Similarly in women's knee high or thigh high hose, as well as men's calf length hose, there is a tendency for parallel sided elasticised retaining bands to roll over on their upper edges during physical movements by the wearer.

U.S. Pat. No. 3,914,799 describes a knitted pantihose garment wherein the panty portion is made from a semi-elastic fabric including nylon and Lycra (Trade Mark of Du Pont) to form a control brief. Extending between the waistband and the crotch region in the rear panty portion is an elastic shaping band located between the gluteus maximi to contour a wearer's buttocks.

U.S. Pat. No. 4,412,433 describes a pantihose garment having an integrally knit crotch region which is formed by knitting a substantially rectangular region of course portions in each of the stocking blanks with the same body yarn being knit in the crotch area as is knit in the adjacent areas of the pantihose. A reinforcing yarn is knit in selected ones of these course portions to increase the bulk of the crotch region and a pattern of such stitches is formed to provide openings in the crotch region for ventilation. An hydrophilic yarn such as cotton is knit in plated relationship on the inside and in selected course portions of the body yarn to provide moisture absorbence in the crotch region.

U.S. Pat. No. 3,651,670 describes a knitted pantihose garment wherein, in place of a welt, there is a compressive stretch fabric integrally knit with the hose to form a compressive girdle portion. The girdle portion of each hose has front and rear panels which are knit so as to provide more fabric in the rear panel than in the front panel with the front panel averaging less stitch loops per course than the rear panel for the same number of wales in the course.

U.S. Pat. Nos. 3,999,406 and 4,040,128 describe a one piece construction for pantihose wherein a tube of knit fabric has a waist opening formed in one side of the central region and in U.S. Ser. No. 4,040,128 a crotch slit is formed in the tube opposite the waist opening.

U.S. Pat. No. 4,021,861 describes a seamless crotch pantihose garment comprising a tubular blank slit walewise to form a body receiving opening opposite to the seamless crotch. A decorative lace-like material of substantially greater strength than the tubular blank is sewn onto the body portion of the blank about the slit to define a panty portion wherein the material provides the additional depth required to provide a satisfactory reach or rise from the crotch to the waistband.

U.S. Pat. No. 4,872,324 describes a turned welt-type knitted waistband for pantihose wherein selected periodic courses in an annular region of the inward welt ply have an uncovered elastomer filament in alternate knit and float stitches for partial exposure of the float stitches for intermittent frictional contact with a wearer's body to assist in retaining the waistband in place when worn.

French Patent Application FR 2290855 describes pantihose in which the upper edge of the panty portion is cut obliquely to remove a portion and to form a waistline which descends from the back to the front. It is considered that this configuration could cause the rear elasticized waist band portion to creep downwardly with repeated standing and sitting.

Japanese Patent Application JP 97-242202 describes a maternity panty with a cloth panel insert in the front region.

German Patents 2909613 and 2650167 are concerned with pantihose garments having conventional elasticized waistbands.

European Patent Application EP 0711513 describes pantihose wherein the panty portion is configured as a control brief with the rear panty portion having greater stretch than the front portion.

International Patent Application PCT/IT97/00263 describes a pantihose construction designed to rest on the hips of a wearer. This garment does not have an elasticized waistband but relies upon either a tensioned front panel or crossed over upper hose portions to form a V shaped panty upper waist portion which assists in locating the garment on a wearer's hips.

U.S. Pat. Nos. 5,762,533, 5,579,894, 3,797,501, 2,424,651 and 2,367,328 all deal with undergarments having some control function with regions of differing elasticity.

U.S. Pat. Nos. 4,059,973, 3,802,229, 3,599,241, 3,566,624, 3,487,473, 504,402 and 3,824,812 describe differing pantihose or tights constructions to aid in fit or comfort and U.S. Pat. No. 2,687,526 describes a maternity undergarment.

U.S. Pat. No. 4,523,337 describes garments having V-shaped front and back waistbands being formed of a fabric which is adapted to stretch and exert recovery forces along lines which generally extend from the opposite outer sides of the wearer's hips toward the longitudinal centreline of the torso of a wearer of the garment.

U.S. Pat. No. 4,400,832 describes pantihose garments having a support structure comprising twin, diagonally inclined halves forming stress vectors directed between the hips and pelvic region of a wearer. Extreme ends of the support structure halves converge at the front and rear of the crotch panel forming an anchor point at the pelvic region for v-shaped front and rear waistband portions.

U.S. Pat. No. 5,023,957 describes a pantihose garment to be worn under a revealing garment such as a G-string. The waistband follows a general v-shape at the front and back of the garment to be hidden by the waistband of the G-string when worn over the pantihose garment. It is considered that this pantihose garment relies upon the G-string for support on the wearers hips.

The extensive prior art in the field of undergarments such as control briefs and girdles and pantihose is a reflection of ongoing attempts to improve fit, comfort and functionality of these garments.

As reflected in many of the abovementioned prior art documents, waistbands for pantihose typically comprise a continuous loop of elasticised material sewn to the upper welt of a pantihose body.

The continuous loop is formed by sewing, adjacent free overlaid ends of a band of elasticised material, perpendicularly to the parallel edges of the band.

The free edges adjacent the transverse seam are then overlooked to prevent fraying and in some cases the seam, opposite the overlooked portion are reinforced by stitching across the seam.

While generally effective for its intended purpose, this form of finishing a waistband for pantihose does suffer some disadvantages.

The overlooked free ends of the elasticised band are generally located on the inner side of the band at the back or one hip side such that with close fitting outer garments, an unsightly bulge can occur.

Moreover, with a tight fitting waistband and tight fitting outer garments, the compression of the overlocked seam against a wearer's skin for any length of time can give rise to discomfort.

SUMMARY OF THE INVENTION

Accordingly, it is an aim of the present invention to provide a low waisted pantihose or undergarment which overcomes or alleviates at least some of the problems of prior art pantihose or undergarments.

It also is an aim of the present invention to overcome or ameliorate at least some of the disadvantages of prior art elasticised hose or garment retaining bands and to provide a retaining band having a generally concave front portion.

According to one aspect of the invention, there is provided a pant garment having a waistband adapted in use to be supported by the hips of a wearer, said garment characterised in that a front portion of said waistband is generally formed in a downwardly concave v-shape and wherein a generally central portion of the garment, extending between the front waistband portion and a crotch region, has, in a longitudinal axial direction, a greater modulus of elasticity than adjacent regions.

Preferably, the waistband has a rear portion that is oriented substantially horizontally in use so that said front portion is located lower on the wearer than the rear portion.

Suitably, the distance between said front portion of the waistband and a central crotch region is less than the distance between said rear portion of the waistband and a central crotch region.

If required, the waistband may be formed integrally with said pantihose.

The waistband may be attached to an upper portion of said garment by stitching or other suitable attachment means.

The front portion of the waistband may be generally V-shaped with front elements tapering downwardly from opposite hip regions to a generally central front region.

If required, the front portion of the waistband may comprise a generally downwardly arcuate concave curve extending from adjacent opposite hip regions.

Alternatively, the front portion of the waistband may comprise downwardly arcuate convexly curved front elements extending from opposite hip regions.

Suitably, one or more elasticized panels may extend between the front waistband portion and the crotch region of the garment.

Preferably, said one or more panels are integrally formed with the garment.

Most preferably, the garment is formed from a knitted fabric comprising nylon and elastane yams.

The garment may comprise men's and/or women's briefs.

Alternatively the garment may comprise a pair of pantihose.

According to a second aspect of the invention there is provided an elasticised waist band for undergarments, said waistband comprising:

a continuous band of elasticised material having a transverse seam sewn through overlaid portions of said band at a position spaced from free ends of said band and wherein each free end of said band are folded back upon a respective adjacent inner portion of waistband.

If required the free ends of said band may be secured to a respective adjacent band portion by stitching.

Suitably the free ends of said band are secured to a respective adjacent band portion by stitching which attaches a welt of a body portion of a pantihose garment thereto.

The transverse seam may be sewn perpendicular to a longitudinal axis of said waistband.

Alternatively the transverse seam may be sewn at an angle of from 25° to 65° relative to said longitudinal axis.

Suitably the transverse seam is reinforced adjacent opposed edges of said waistband.

According to yet another aspect of the invention there is provided a hose or garment retaining system comprising:

an elasticised retaining band having a generally parallel sided rear portion extending in use around a rear portion of a wearer's anatomy and a front portion extending in use at least partially across a front portion of a wearer's anatomy, said retaining band characterised in that said rear portion has a modulus of elasticity extending generally longitudinally, parallel to upper and lower boundaries thereof and said front portion comprises a generally downwardly extending arcuate concave curve in an upper boundary thereof, said front portion further characterised in that the front portion has a greater modulus of elasticity in a transverse direction than longitudinally of the front portion.

Preferably the front portion of the hose or garment adjacent the front portion of the retaining band has a modulus of elasticity greater in the longitudinal axial direction of a wearers anatomy than in a direction transverse thereto.

If required the front portion of the hose or garment may comprise one or more elasticised panels.

Suitably said one or more elasticised panels are formed integrally with said front retaining band portion.

If required, said front retaining band portion may comprise a ribbed construction with ribs extending in a normally upright direction.

BRIEF DESCRIPTION OF THE DRAWINGS

In order that the invention may be more readily understood and put into practical effect, reference will now be made to preferred embodiments shown in the accompanying drawings in which:

FIGS. 8 and 9 show alternative shapes applicable to the lowered front portion of the waistband in the pantihose of the invention;

DETAILED DESCRIPTION OF THE DRAWINGS

Figure 1:
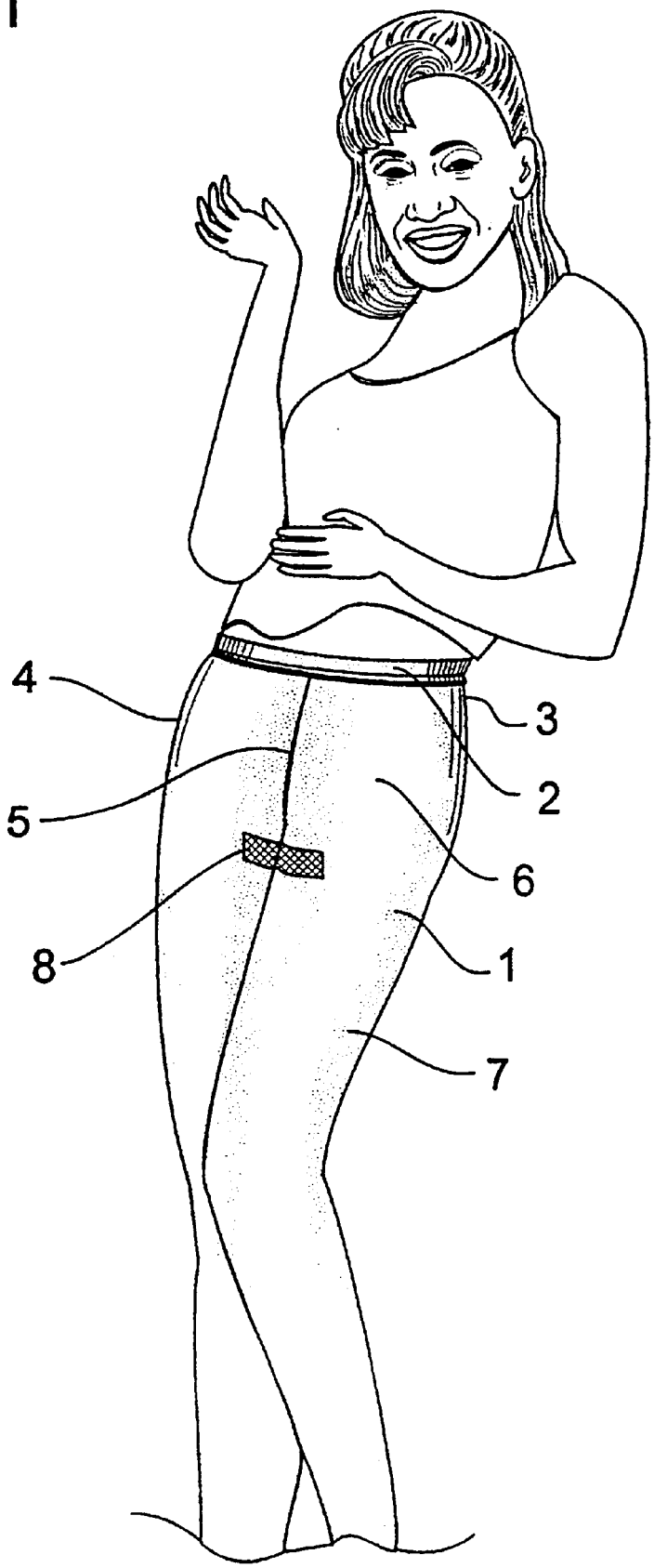
FIG. 1 shows a typical prior art pantihose.

In FIG. 1 there is shown a conventionally fitting prior art pantihose garment 1 having a waistband 2 located at or above a wearer's waistline 3.

The waistband of prior art pantihose garments is often about 50 mm to about 75 mm above the wearer's upper hip bone protrusions or iliac crests 4.

Typically, the garment is constructed from a pair of tubular blanks which are slit in a walewise direction and the blanks are sewn together along a front seam 5 and a rear seam (not shown) to form a panty portion shown generally at 6 and leg portions 7.

To facilitate insertion by sewing of a gusseted crotch portion (not shown), integrally knit reinforcing regions 8 are formed in the hose blanks by incorporating in addition to the body yam a heavier denier yarn. Alternatively, the crotch region may be reinforced by changing the stitch loop patterns to "bulk" the region with additional yam.

Figure 2:
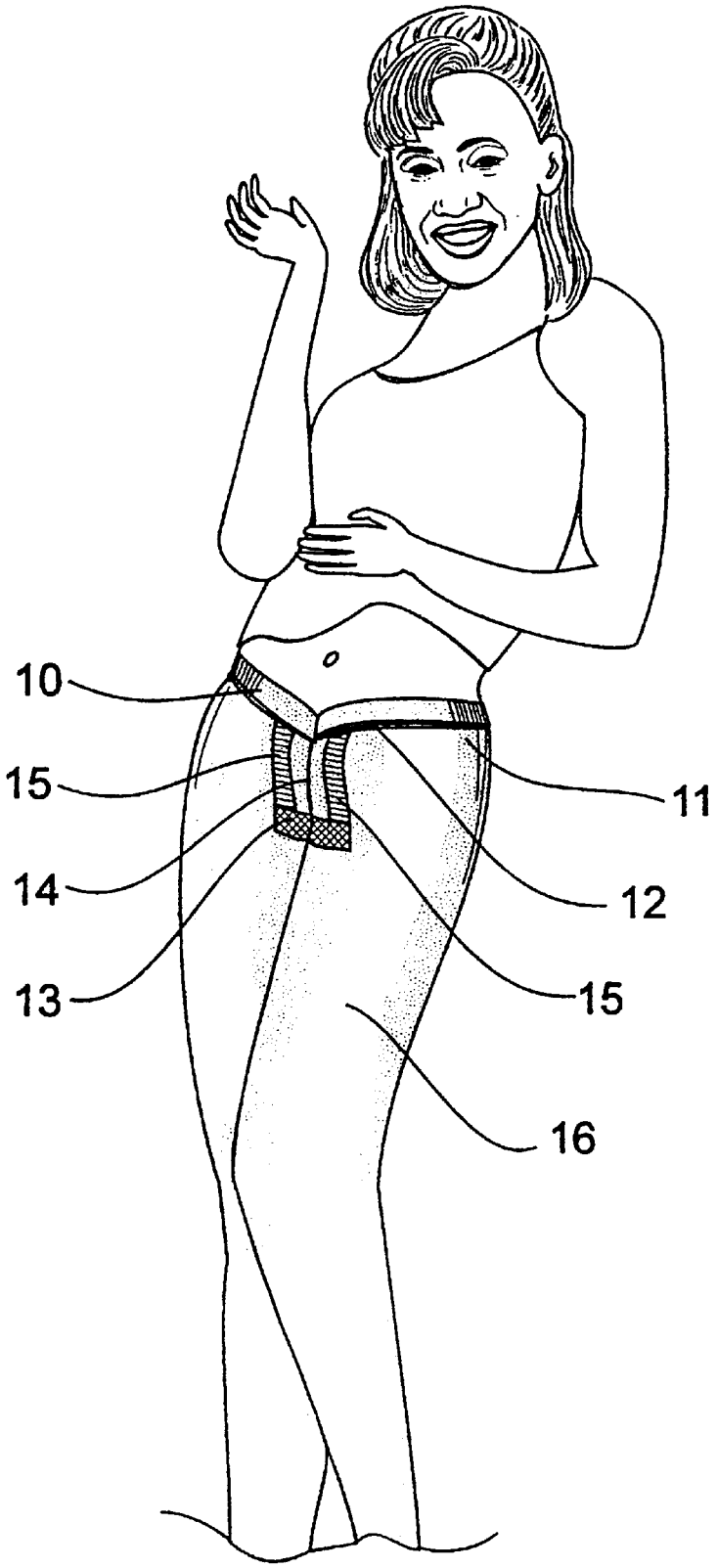
FIG. 2 shows pantihose according to the present invention.

FIG. 2 shows a preferred embodiment of the invention.

In this embodiment, the waistband 10 is positioned with a lower reach or rise from the crotch region to locate the waistband 10 on or just above the wearer's upper hip bone protrusions 11.

While the rear portion (not shown) of the waistband extends generally horizontally across the wearer's lower back, the front portion 12 of waistband 10 is shaped to dip downwardly by about 10 mm to about 50 mm towards the crotch region.

Suitably, the panty portion includes a gusseted crotch portion (not shown) secured to the integrally knit reinforcing portions 13. If manufactured from separate tubular blanks, the garment will have a central seam 14 which may be elasticized if required.

Located on either side of the seam 14 are waistband front retaining panels 15 extending between the waistband 10 and the reinforcing portions 13.

The retaining panels 15 may be integrally knit or they may be sewn into the garment.

The retaining panels 15 have a higher modulus of elasticity along their longitudinal axes than the fabric of the surrounding panty portion 16 so that in use, any tendency for the front waistband portion to rise under the influence of transversely resolved elastic tensions therein is resisted.

Although turned welt knitted waistbands can be employed with the pantihose garments according to the invention, it is preferred that a separate elastic waistband is employed to allow easy contouring of front portion 12 of the waistband.

Figure 3:
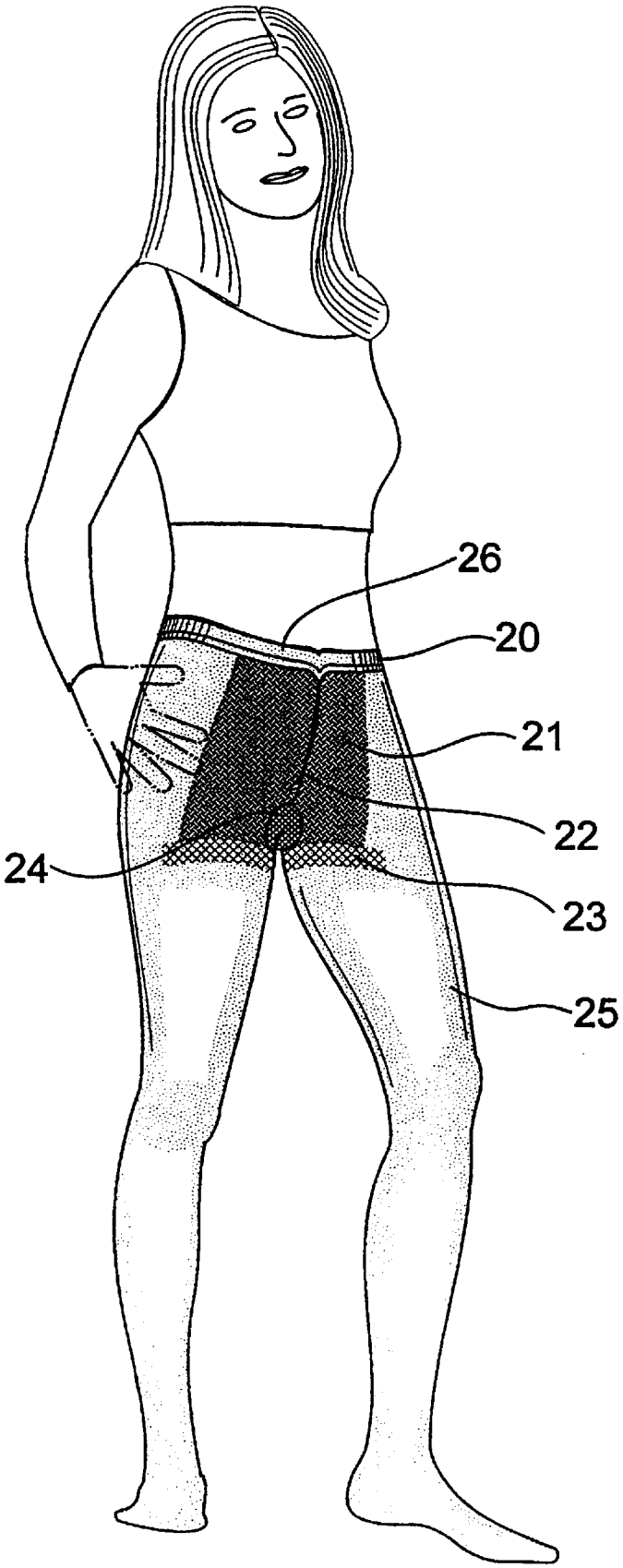
FIG. 3 shows a modified form of pantihose in accordance with the invention.

In FIG. 3, there is shown another form of pantihose constructed in accordance with the invention having a waistband 20, retaining panel 21, central seam 22, reinforcement regions 23 and crotch region 24 and leg portions 25. The waistband 20 is provided with a V-shaped front portion 26.

Panel 21 may comprise a separate panel of knitted yarn sewn to the front of the panty portion of the garment or its may be integrally knit.

Panel 21 has a greater modulus of elasticity in a direction parallel to seam 22 than the surrounding regions of the panty portion. The modulus of elasticity may be adapted by conventional knitting techniques to vary from a minimum value adjacent the opposed outer edges of panel 21 to a maximum value in the region of central seam 22.

Figure 4:
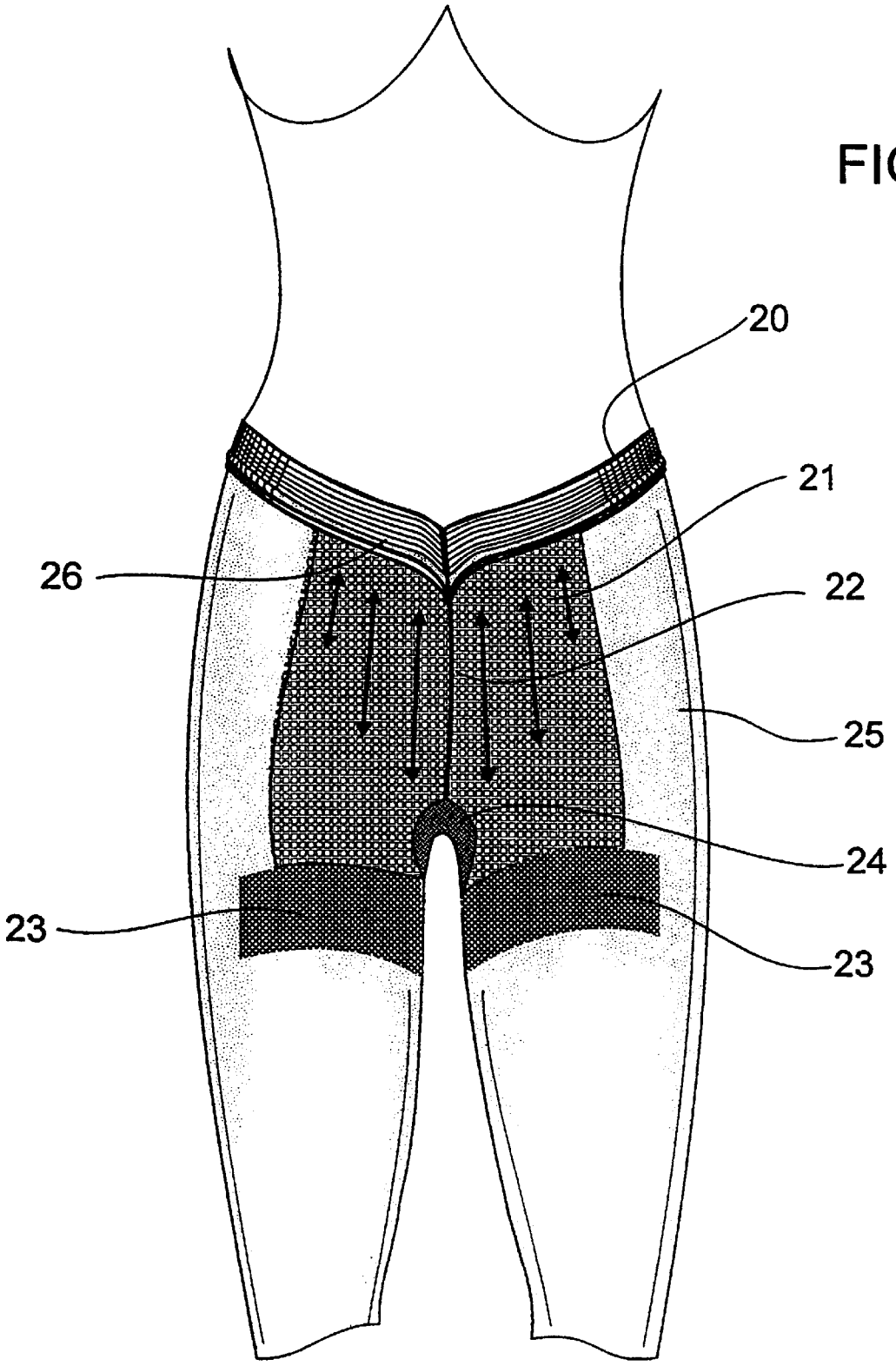
FIG. 4 shows a more detailed view of the pantihose shown in FIG. 3.

In FIG. 4, is a more detailed view of the pantihose shown in FIG. 3 with arrows representing variation of elastic restoring forces across panel 21.

Figure 5:
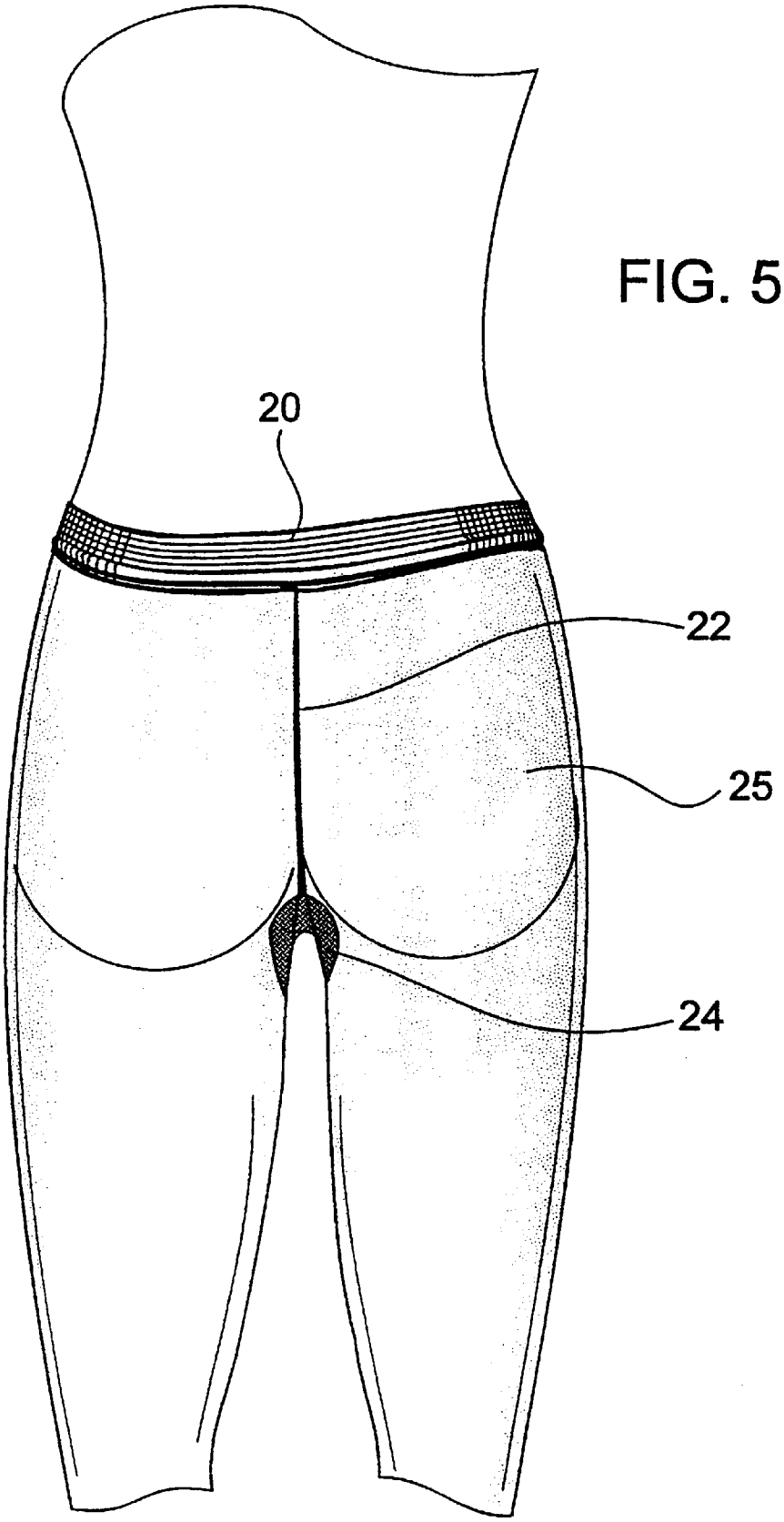
FIG. 5 shows a rear view of the pantihose shown in FIG. 3 or FIG. 4.

FIG. 5 shows a rear part of the pantihose shown in FIGS. 3 and 4 and it will be noted that waistband 20 has a generally horizontal orientation. There is also shown central seam 22 and crotch region 24.

Figure 6:
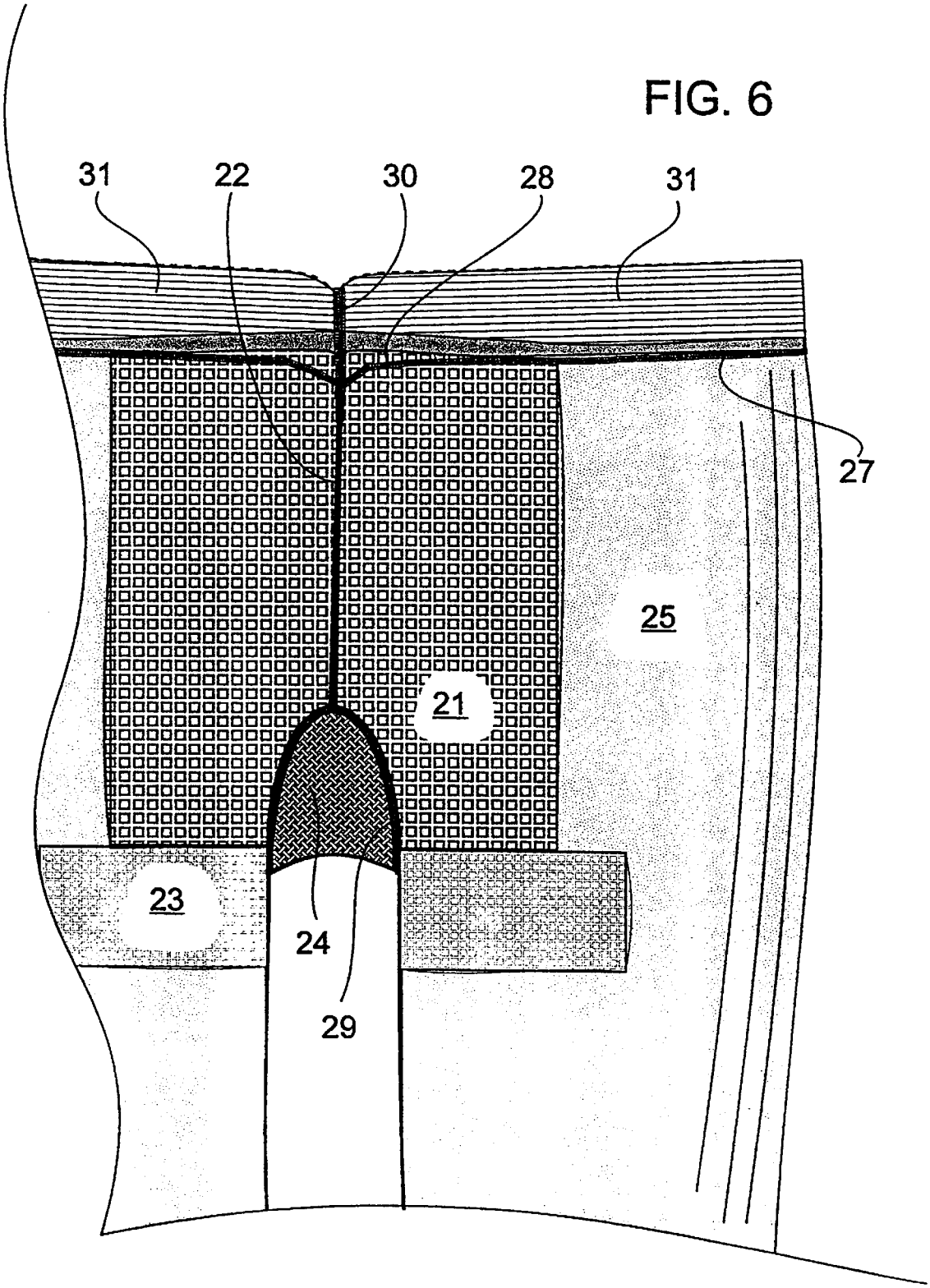
FIG. 6 shows a reverse view of the front section of the pantihose shown in FIGS. 3 and 4.

FIG. 6 shows schematically a reverse face of the front portion 26 of waistband 20 under transverse tension when not being worn. It will be noted that waistband 20 is stitched in the hip regions to a welt 28 extending around the upper panty portion 25. Towards the central region, the waistband stitch seam 27 extends below welt 28 into panel 21 to accommodate the v-shaped front waistband portion. There is also shown seam 29 bounding crotch region 24 which merge with central seam 22. Stitching 30 also connects parts 31 of waistband 20 and continues partly along central seam 22 as shown.

Figure 7:
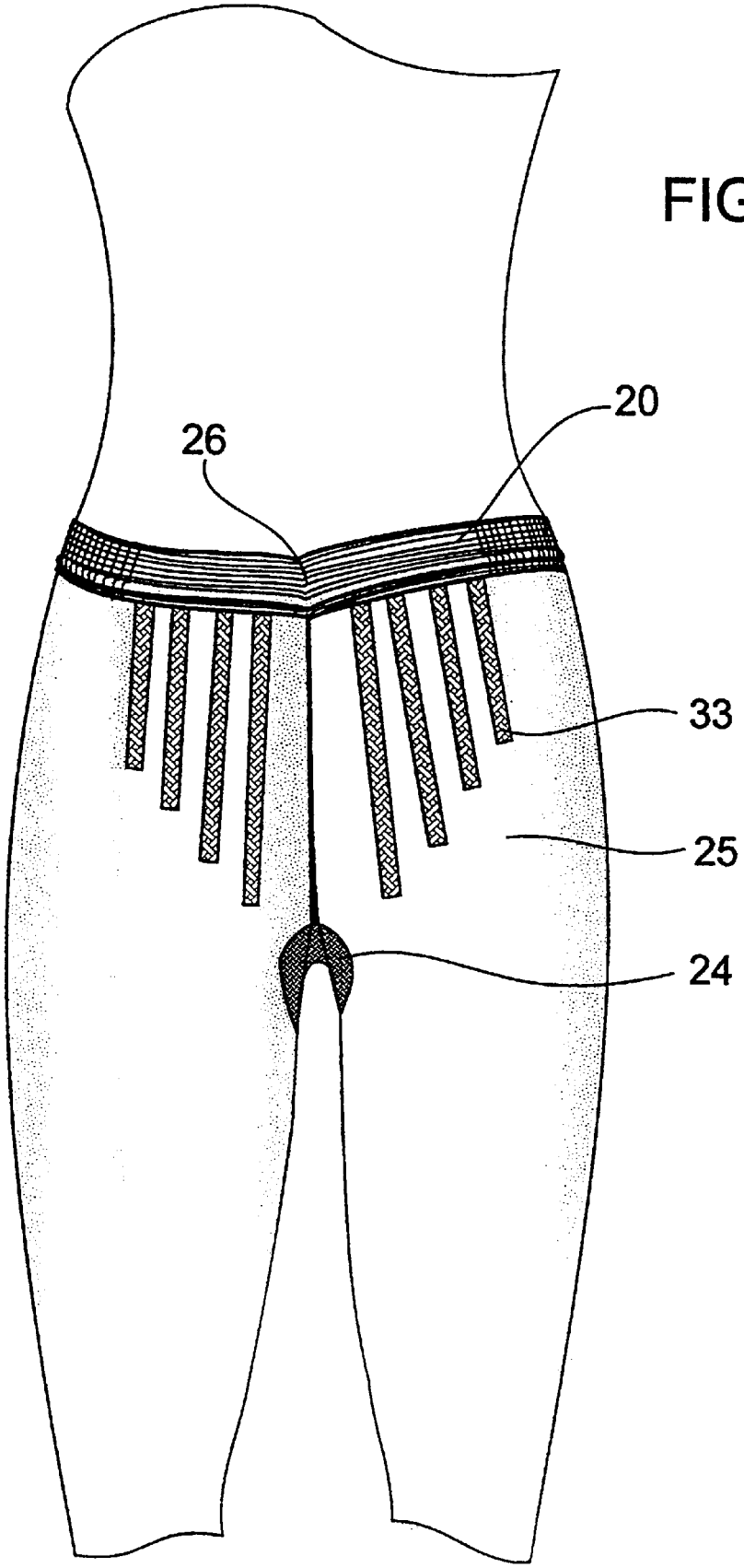
FIG. 7 shows another modified form of pantihose in accordance with the invention.

FIG. 7 shows a modified form of pantihose in accordance with the invention wherein the waistband retaining means comprises a plurality of elasticised strip regions 33 which are substantially parallel to each other although this is not essential. Elasticised strips 33, as in the case of resilient panels 15 or resilient panel 21, provide a zone below the lowered front portion 26 of waistband 20 which urges the front portion 26 progressively downwardly with the greatest tension in the central region.

FIGS. 8 and 9 show alternative shapes to the front portion 26 of waistband 20. FIG. 8 shows a scooped or scalloped shape 26A and FIG. 9 shows a trapezoidal cut 26B. For the sake of simplicity, the resilient waistband retaining means are not shown in these figures.

Figure 10A:
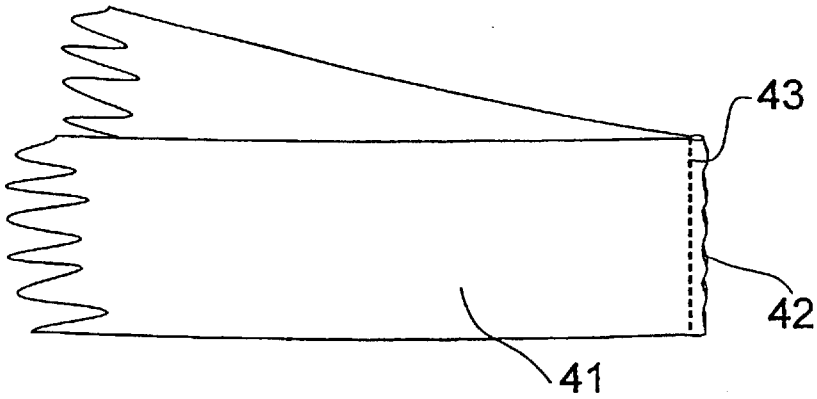
FIG. 10 shows a typical prior art waistband construction.
Figure 10B:
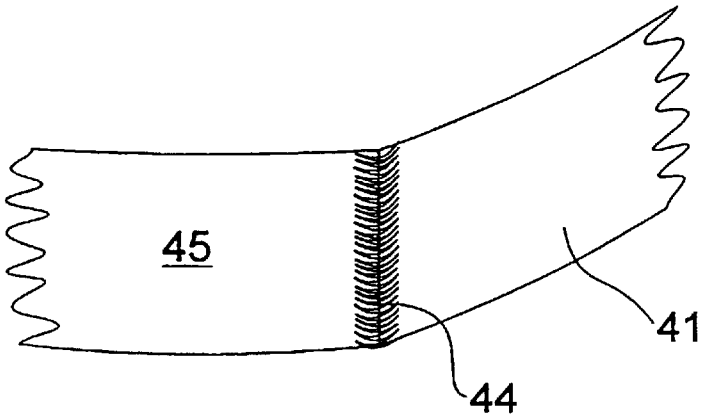

In FIG. 10*a* a prior art waistband for pantihose is formed by looping a band 41 of elasticised material so that the free ends 42 thereof are superimposed. The free ends 42 are stitched together by a transverse seam 43.

In a secondary step, the free ends 42 are then overlooked as shown in FIG. 10*a* to secure the free ends 42 against fraying. The overlooked portion 44 forms a transverse ridge across the inner face 45 of the waistband loop.

Figure 10C:
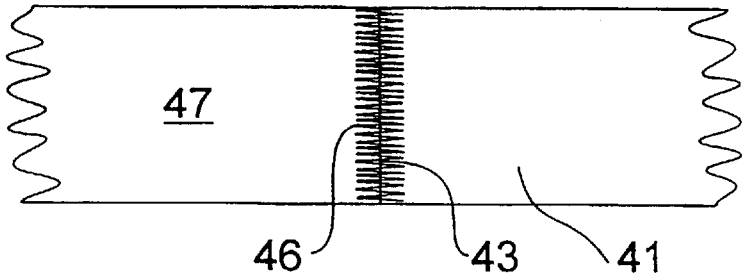

FIG. 10*c* shows the outer face 47 of the waistband loop where the transverse seam 43 may be reinforced by cross stitching 46.

Figure 11A:
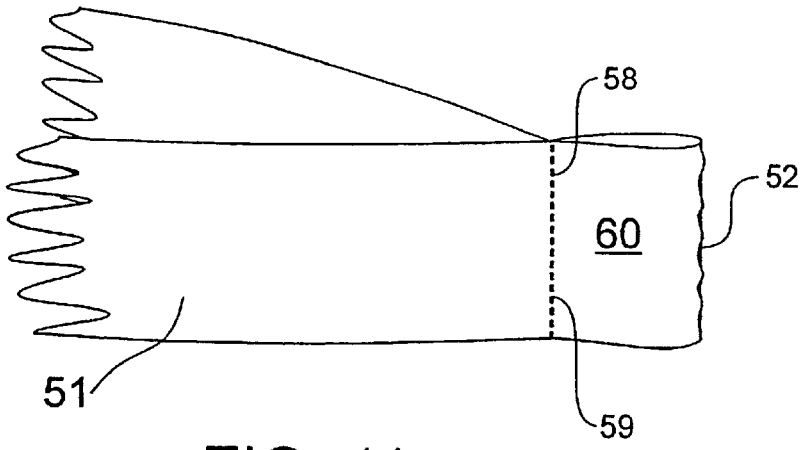
FIG. 11 shows a waistband construction according to one aspect of the invention.

FIG. 11 a shows one embodiment of the invention wherein the waistband is formed by looping a band 51 of elasticised material so that the free ends 52 thereof are superimposed. Spaced at a distance from free ends 52, a transverse seam 58 is stitched with a reinforcing stitch 59 leaving tab-like free ends 60 at the end of the waistband loop so formed.

Figure 11B:
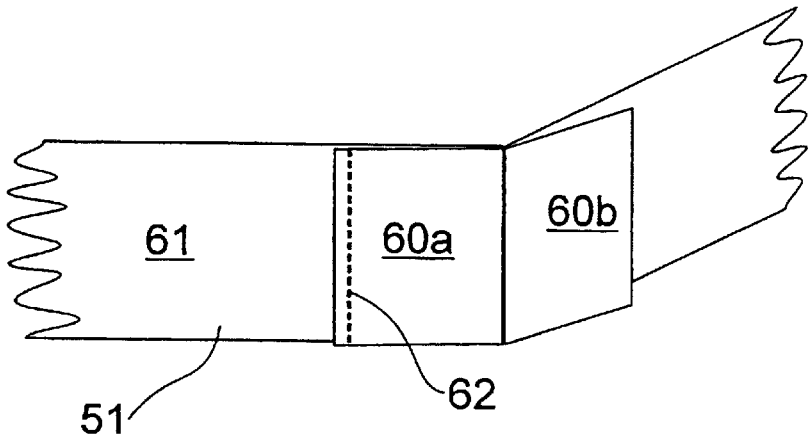

As shown in FIG. 11*b*, tab 60*a* may be stitched on to the inner face 61 of the waistband loop by a transverse seam 62 or any other stitching pattern before securing the waistband to the welt of the body portion of a pair of pantihose.

Alternatively as represented by tab 60*b*, the free ends 60 simply may be folded back upon a respectively adjacent portion of waistband prior to attachment to the welt of the pantihose body. The stitching required to secure the band to the welt is sufficient to retain the tab 60*b* flat against the inner face of the waistband.

Figure 11C:
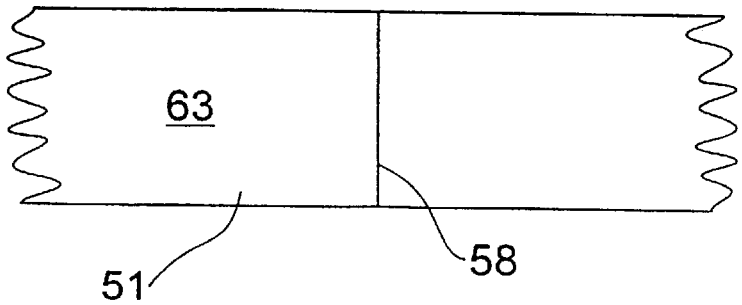

FIG. 11*c* shows an outer face 63 of a waistband according to the embodiment of FIG. 11.

Although a cross stitched reinforcement of the type shown in FIG. 10*c* may be employed, the use of a well known programmable stitching apparatus enable a variety of reinforced stitch patterns to effect a reinforced transverse seam.

Figure 12A:
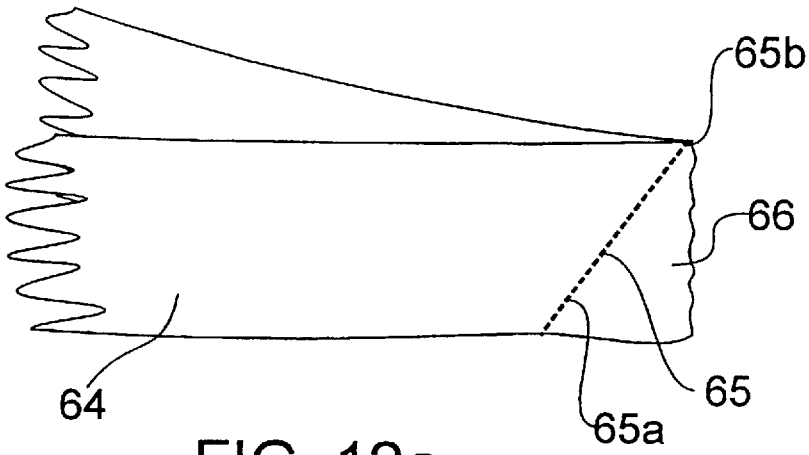
FIG. 12 shows an alternative waistband construction according to the invention.
Figure 12B:
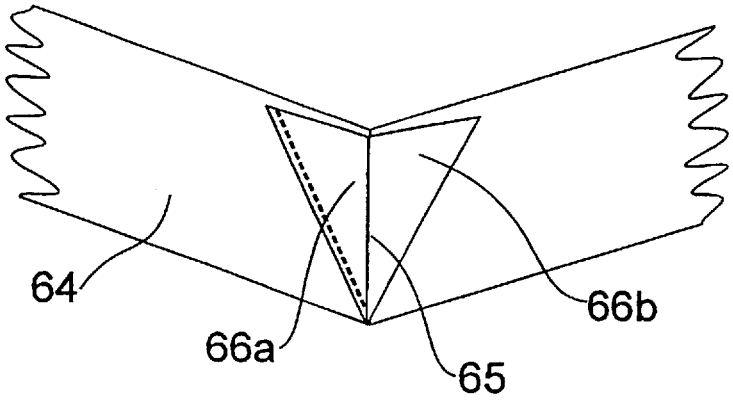
Figure 12C:
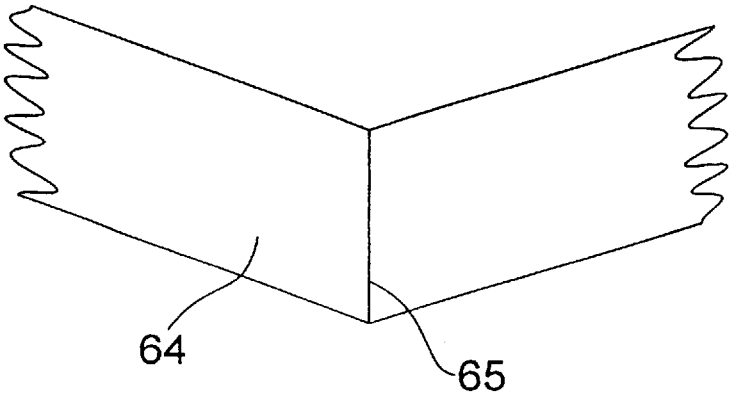

FIG. 12 shows a waistband for use with garments of the type described herein.

In this embodiment as shown in FIG. 12*a*, a programmed stitcher forms a transfer stitch 65 at about 45° to the longitudinal axis of the elasticized band 64. This stitch is a reinforcing stitch with reinforced regions, 65*a*, 65*b* on opposite edges of the waistband.

For low waist garments of the type described herein it is important that at least the seam region 65*a* is reinforced as the geometry of these garments is such that the tensile load in the waistband is greatest in that region.

In FIG. 12 as in FIG 11*b*, the free end tabs 66 may be stitched to the inner face of the waistband as exemplified by tab 66*a* or otherwise folded and secured to the waistband when the waistband is fitted to the pantihose body by stitching.

FIG. 12 shows the front face of the waistband according to this aspect of the present invention.

Figure 13:
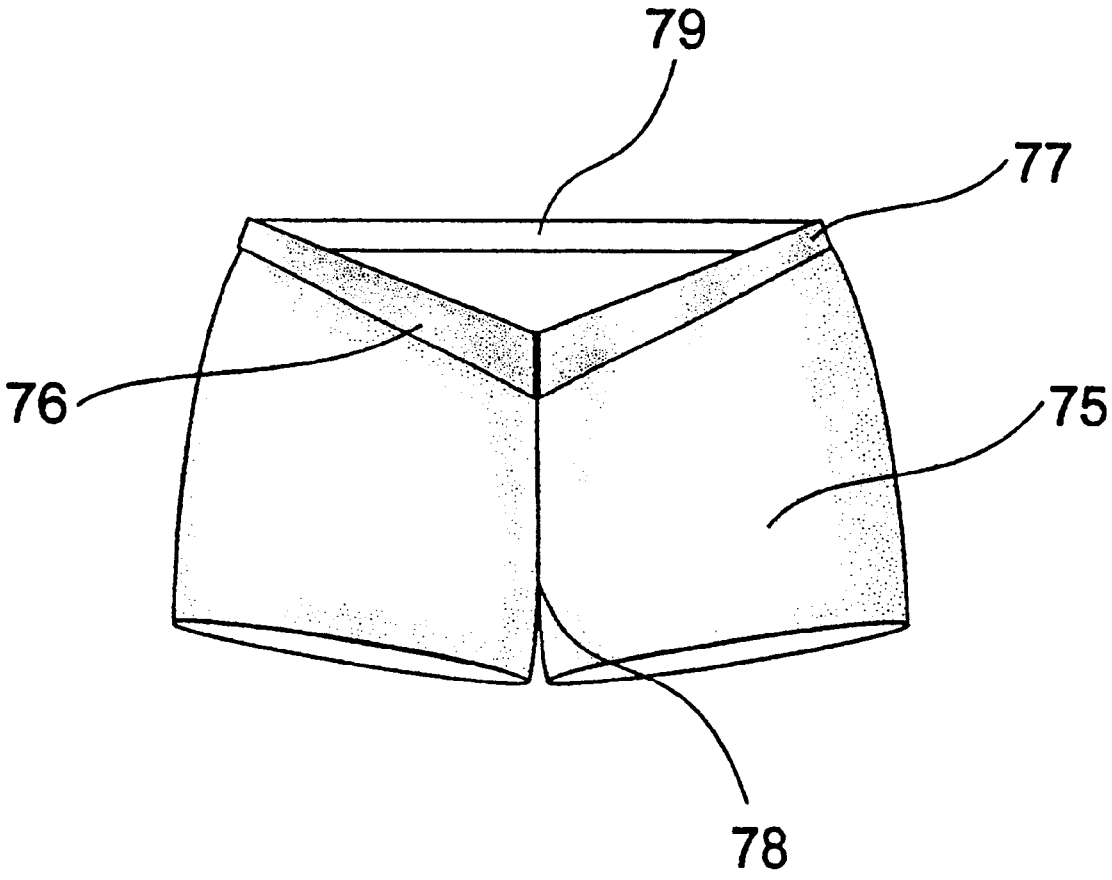
FIG. 13 shows a pair of briefs in accordance with the invention.

FIG. 13 shows a pair of briefs according to the invention.

The body portion 75 of the briefs may be styled to suit men or women and include appropriate adaptations such as a fly front for male briefs.

The front portion 76 of elasticised waistband 77 is formed in a generally v-shaped configuration such that the distance between the central front waistband portion 76 and the central crotch region 78 is less than the distance between the rear portion 79 of the waistband and the crotch region.

In this embodiment, the elasticised waistband progressively increases in width as it extends from the hip region to the central apex of the v-shaped front waistband portion 76 thereby giving progressively increasing tension capacity in the waistband.

It has been found that the elasticised waistband design applicable to pantihose embodiments described above is equally applicable as retaining bands for women's knee high hose and thigh high hose as well as men's calf length hose.

Figure 14:
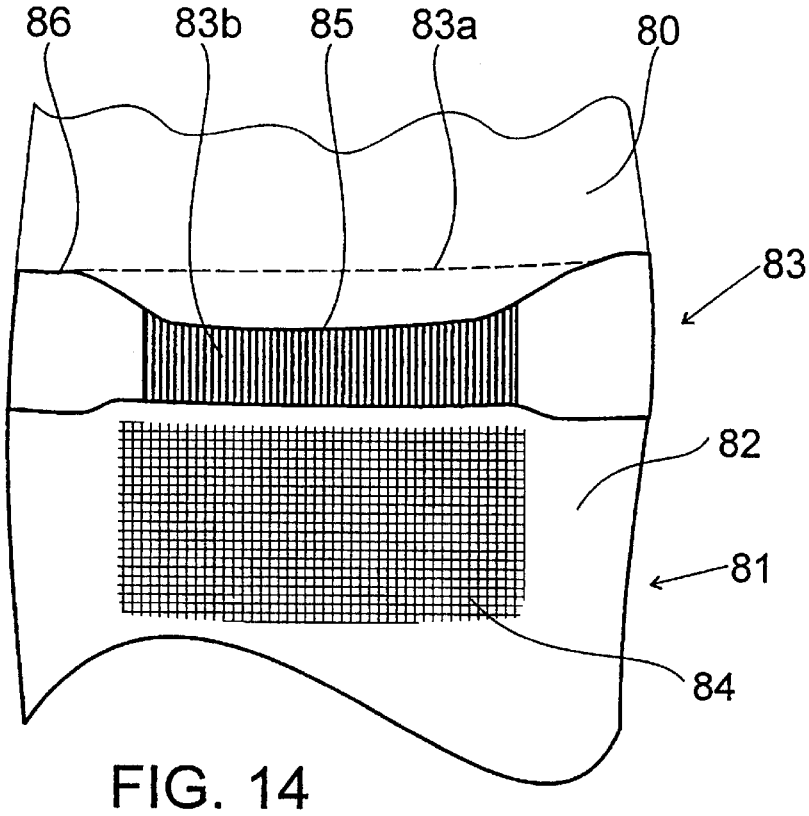
FIG. 14 shows a partial view of an item of hose incorporating an elasticised retaining band according to yet another aspect of the invention.

FIG. 14 shows a partial front view on a wearer's leg 80 of the upper part of a man's calf length hose 81 having a hose body portion 82 and an elasticised retaining band 83.

Retaining band 83 comprises a generally parallel sided band 83*a* extending around the rear and sides portion of a wearers leg 80 and forming a generally central front truncated portion 83*b*.

Band portion 83*a* is elastically resilient with a restoring force under tension generally parallel to the upper and lower boundaries thereof.

Band portion 83*b* is elastically resilient but with a restoring force under tension greater in a direction transverse to the band than longitudinally thereof.

Suitably the band 83 is knitted integrally with the hose body portion 82 and the regions of longitudinal and transverse elasticity are imparted by selection of conventional stitch patterns and/or yarn type.

It will be noted that front band portion 83*b*, knit with a ribbed configuration as shown, forms a truncation in the width of band 83 due to the transverse band tension.

Immediately below front band portion 83*b* there is an integrally knit tension panel 84 having a modulus of elasticity greater in the direction of the longitudinal axis of the wearer's leg than transversely thereof.

When worn, the combined effects of the vertical tensions in band portion 83*b* and the panel 84 cause the upper edge of band 83 to form a central concavity 85 as shown.

In practice it has been shown that a conventional parallel sided retaining band for hose, when worn with the upper edge in a plane generally normal to the longitudinal axis of a wearer leg, on an upwardly divergent part of a wearers leg such as a calf region, upper knee region or thigh region, has a tendency to roll down from the upper edge.

By contrast, the retaining band of FIG. 14 imparts a somewhat greater tension in the upper edge of the band 83 by virtue of the tensioned concavity 85 whereby, the upper edge 86 of band 83 is biassed to an inward curl or roll thereby resisting the tendency to roll outwardly and downwardly.

Figure 15:
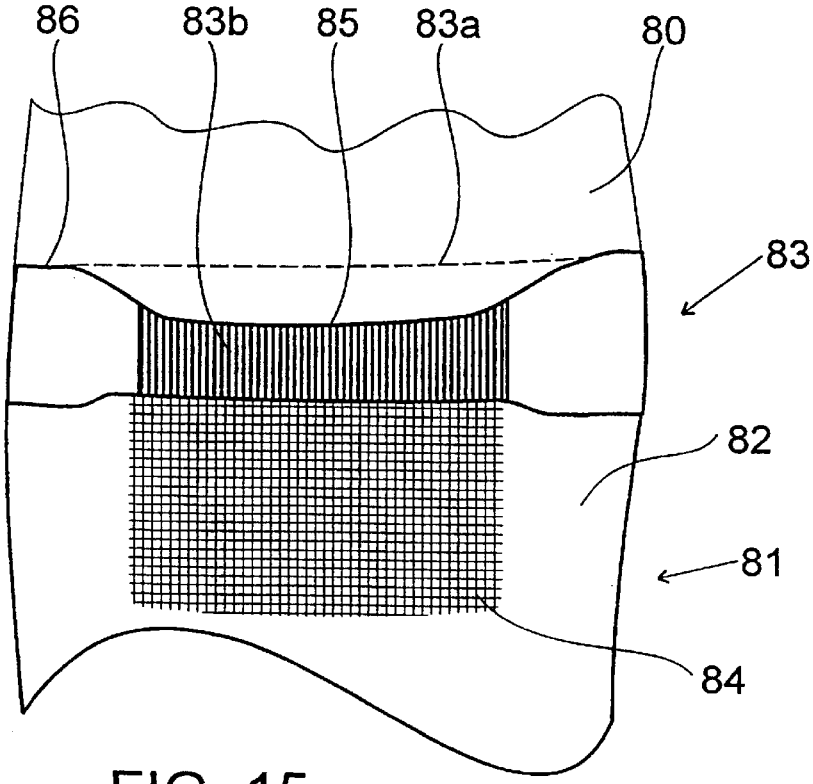
FIG. 15 shows an alternative embodiment of the retaining band of FIG. 14.

FIG. 15 shows an alternative embodiment of the arrangement of FIG. 14.

In this embodiment like features are numbered with like numerals and possess like characteristics.

FIG. 15 shows a similar hose configuration except that tension panel 84 is integrally knit with front band portion 83*b*.

Although front band portion 83*b* is knit with a ribbed stitch as shown, both panel 84 and front band portion 83*b* have a greater modulus of elasticity in a vertical direction when worn than in the transverse direction.

Figure 16:
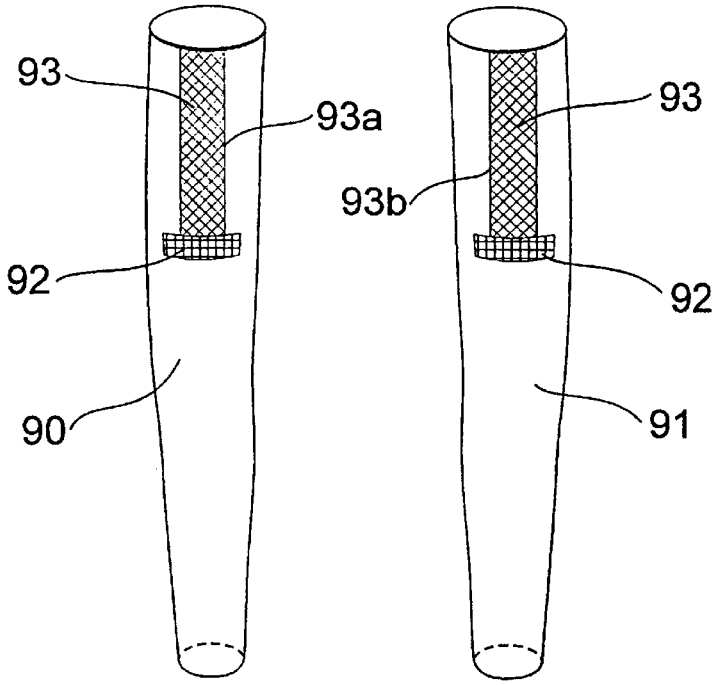
FIGS. 16–18 show a method of constructing pantihose according to the invention.
Figure 17:
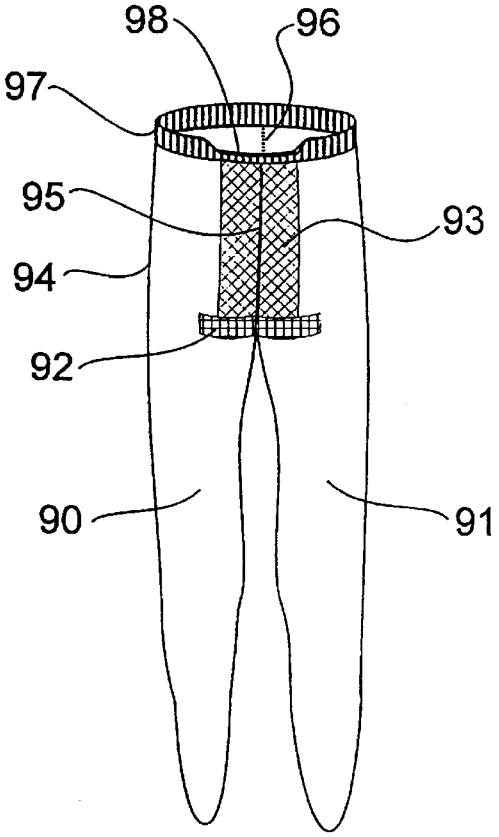
Figure 18:
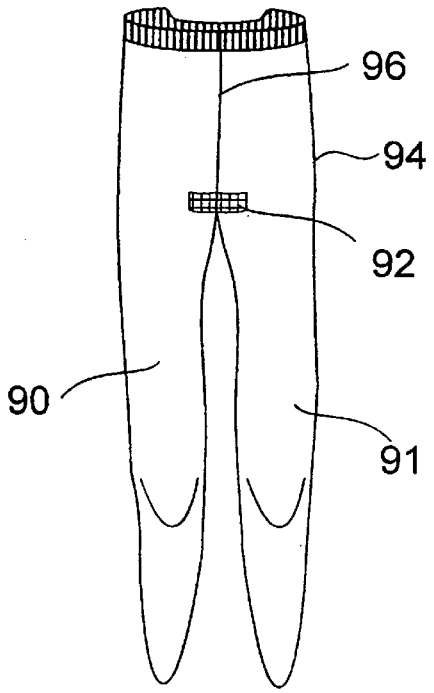

FIGS. 16 to 18 show a method of assembly of a pair of pantihose embodying a waistband construction functioning in the same manner as the retaining band of the men's hose shown in FIGS. 14 and 15.

FIG. 16 shows tubular hose blanks 90, 91 knitted in a conventional manner.

The blanks 90, 91 each include a reinforcing panel 92 and also a tension panel 93 having a modulus of elasticity greater in the longitudinal axis direction than in the transverse direction.

Integrally knit panels are formed by conventional knitting methods using selected stitch patterns and/or yarns.

The pantihose garment is formed by slitting each hose blank 90, 91 along the boundaries 93*a*, 93*b* between the panel 93 and the adjacent portion of the hose blank and then stitching together the free edges of panels 93*a*, 93*b* and the free edges of the hose blanks 90, 91 to form front and rear seams in the pantihose garment.

FIGS. 17 and 18 respectively show the front and rear views of the pantihose 94 assembled from the blanks 90, 91 of FIG. 16 with respective front and rear seams 95, 96.

To finish the garment the upper edge of the pantihose garment is folded and stitched to form a turned welt to act as a waistband 97.

As shown in FIG. 17, the generally parallel sided waistband 97 is lightly elasticated about the major part of its periphery except of the front portion 98 of truncated band width.

When worn the combined effects of the peripheral waistband tension and the greater modulus of elasticity in the longitudinal axis in the truncated waistband portion 98 and tension panels 93 from a concave dip in the upper edge of front portion 98.

As with the hose shown in FIGS. 14 and 15, the radially inwardly directed tension vectors in the upper edge of waistband 97 not only resist rolling down but also assist in securing the garment on a wearer's hips without undue waistband tension.

In all of the embodiments herein described, it is considered that the combination of the concave or v-shaped front retaining band region and the tension panel serve to redirect waistband tension vectors to resist rolldown and, without undue waistband tension, to more securely and more comfortably retain the garment on a wearer's body.

In practice, it has been found that pantihose-according to the invention are securely and comfortably supported on a wearers hips even over prolonged periods of time. Moreover, even with exaggerated physical movements such as repeated sitting and standing, crouching or bending, there is no tendency for the waistband to roll downwardly.

Although there is a degree of tension between the crotch region and the front portion of the waistband, this tension is so slight as to be generally unnoticed.

Although the prior art has proposed pantihose garments with downwardly converging v-shaped waistbands, typically both in the front and rear of the garment, effective and comfortable control of these waistbands has not been possible until the present invention.

When prior art garments having elasticised front and rear waistbands are subjected to tension on a wearer, tension in the waistband causes the central v-shaped portions to move upwardly to approximate a conventional circular waistband.

At the same time, tension in the leg portions induces a restoring force in the same direction as the longitudinal axes of a wearer's legs and thus unless there is excessive and uncomfortable tension in the waistband, it can be caused to move downwardly over a wearer's hip regions as there is less stretchable fabric extending between the waistband apices and the crotch region than in the leg portions.

This effect is exacerbated where the apices of the front and rear portions are rigidly anchored together by an inextensible crotch region whereby vertically directed tensile restoring forces are substantially greater over the length of the leg portions as compared to the shorter distances between the apices of the waistband and the crotch region.

It has been found with the present invention that excessive waistband tension is not required to retain a garment on a wearer's hips. Moreover, the relatively lower waistband tension readily permits the position of the waistband on a wearer's hips to be adjusted and at the same time the apex of the front v-shaped portion may be adjusted upwardly or downwardly to suit a wearer's comfort.

While not wishing to be bound by any particular hypothesis, it is believed that the comfort, security and adjustability of the waistband configuration of the present invention for a wide range of body shapes and sizes is due to an effective balance between axial tension in the v-shaped front waistband portion and the tension in the panty portion extending between the central waistband region and the crotch region.

The waistband construction, as illustrated in FIG. 12 is also considered to contribute to the effectiveness of the invention by a greater capacity to retain a v-shape under tension.

It will be clear to a person skilled in the art that many variations and modifications may be made to the invention without departing from the spirit and scope thereof.

For example, the waistband retaining means may comprise a front seam having a higher modulus of elasticity than the surrounding body fabric of the panty portion.

Alternatively, the waistband retaining means may comprise a decorative panel extending between the waistband and the crotch region.

The decorative panel may be a lace-like material and may be in the form of an inverted triangle having its base uppermost.

The decorative panel is suitably of a material having a higher modulus of elasticity than the surrounding body fabric of the panty portion or it may be non-elastic.

The decorative panel may be sewn in conveniently when the crotch gusset is sewn into the garment.

The denier of the pantihose will vary according to the yam density and thus the pantihose may vary from sheer to opaque thereby having a denier within the range of 10–80 as may be required. Usually the panty component of the garment will have a greater degree of opaqueness than the legs.

Preferably the elasticized panels incorporated in the pantihose of the invention will include a resilient fibre such as, for example, LYCRA SPANDEX. The amount of resilient fibre included in the elasticized panels may vary from 2–50% depending upon the opaqueness of the resilient panel. For an opaque resilient panel, for example, the amount of resilient fibre may be about 6% and in a more sheer resilient panel, the resilient fibre content may be around 13%.

Advantageously the resilient panel may incorporate a regular stitch and lock stitch combination such as, for example, 20 denier LYCRA covered with 40/46 nylon microfibre as well as 60/68 nylon microfibre. The term "MICROFIBRE" is a trade mark of DuPont.

What is claimed is:

1. A garment or hose retaining system comprising:

an elasticized retaining band having a rear band portion extending in use around a rear portion of a wearer's anatomy and a front band portion extending in use at least partially over a front portion of a wearer's anatomy, said system characterized in that said rear band portion has a modulus of elasticity extending generally longitudinally thereof in a direction orthogonal to a longitudinal axis of said wearer's anatomy and at least an upper edge portion of said front band portion is urged in use, in a downward direction by a front resilient panel located below said upper edge portion, said front resilient panel having, in a direction parallel with said longitudinal axis of said wearer's anatomy, a modulus of elasticity greater than adjacent regions of said garment or hose.

2. A system as claimed in claim 1 wherein an upper edge region of said retaining band has a greater tension than a lower edge region of said retaining band, in use, to bias an inward curl or roll thereby resisting a tendency, in use, to roll outwardly and downwardly.

3. A system as claimed in claim 1 wherein said front resilient panel is formed integrally with said retaining band.

4. A system as claimed in claim 1 wherein said front resilient panel is formed as one or more elasticized panels in a front portion of said garment or hose.

5. A system as claimed in claim 4 wherein said one or more elasticized panels are located adjacent said retaining band.

6. A system as claimed in claim 5 wherein said one or more elasticized panels are formed integrally with said front band portion.

7. A system as claimed in claim 5 wherein said one or more elasticized panels are positioned below said front band portion.

8. A system as claimed in claim 7 wherein said one or more elasticized panels are connected to said front band portion.

9. A system as claimed in claim 1 wherein said front band portion is formed in a downwardly concave shape.

10. A system as claimed in claim 9 wherein said front band portion is formed in a shallow V shape.

11. A system as claimed in claim 10 wherein said front band portion is convergently tapered away from an apex of said V shape to opposite side portions of a wearer's anatomy.

12. A system as claimed in claim 9 wherein said front band portion is formed as a downwardly arcuate concave curve.

13. A system as claimed in claim 9 wherein said front band portion is formed from downwardly convexly curved regions meeting generally centrally of said front band portion.

14. A garment or hose having a retaining system comprising:

an elasticized retaining band having a rear band portion extending in use around a rear portion of a wearer's anatomy and a front band portion extending in use at least partially over a front portion of a wearer's anatomy, said system characterized in that said rear band portion has a modulus of elasticity extending generally longitudinally thereof in a direction orthogonal to a longitudinal axis of said wearer's anatomy and at least an upper edge portion of said front band portion is urged in use, in a downward direction by a front resilient panel located below said upper edge portion, said front resilient panel having, in a direction parallel with said longitudinal axis of said wearer's anatomy, a modulus of elasticity greater than adjacent regions of said garment.

15. A garment as claimed in claim 14 wherein an upper edge region of said retaining band has a greater tension than a lower edge region of said retaining band, in use, to bias an inward curl or roll thereby resisting a tendency, in use, to roll outwardly and downwardly.

16. A pant garment as claimed in claim 14 wherein said pant garment is in the form of pantihose.

17. A pant garment as claimed in claim 14 wherein said pant garment is a pair of briefs.

* * * * *